United States Patent [19]

Gaia

[11] Patent Number: 4,703,300

[45] Date of Patent: Oct. 27, 1987

[54] TIME LAG ELECTRICAL FUSE

[75] Inventor: Aldino J. Gaia, St. Louis, Mo.

[73] Assignee: Cooper Industries, Inc., Houston, Tex.

[21] Appl. No.: 4,299

[22] Filed: Jan. 7, 1987

Related U.S. Application Data

[63] Continuation of Ser. No. 796,222, Nov. 8, 1985, abandoned.

[51] Int. Cl.[4] ..... H01H 85/04

[52] U.S. Cl. ..... 337/164; 337/163

[58] Field of Search ..... 337/163, 164, 165, 166

[56] References Cited

U.S. PATENT DOCUMENTS 3,342,964 9/1967 Kozacka ..... 337/164

*Primary Examiner*—Harold Broome

*Attorney, Agent, or Firm*—Haight & Hofeldt

[57] ABSTRACT

A composite time lag fuse having an insulating housing enclosing a time delay fuse and an electrical resistance heater which is located in intimate heat transfer relationship with the time delay fuse. The time delay fuse and electrical resistance heater being connected in a series circuit between a pair of conductive end caps closing the ends of the insulating housing. An overload current flow in the electrical resistance heater resulting in the generation and transfer of heat from the electrical resistance heater to the time delay fuse to cause the time delay fuse to interrupt after a predetermined time delay, an overload current flow in the circuit to be interrupted, which is of a lesser magnitude than would otherwise be interrupted by the time delay fuse. For improved short circuit performance, a short circuit fuse is also enclosed in the insulating housing and is connected in the series circuit.

10 Claims, 10 Drawing Figures

TIME LAG ELECTRICAL FUSE

This is a continuation of application Ser. No. 06/796,292 now abandoned 4/7/87, filed Nov. 8, 1985.

BACKGROUND OF THE INVENTION

This invention relates to an improvement in protective devices for electrical circuits, and more particularly to an improvement in electrical fuses.

Electrical fuses are provided for interrupting electrical circuits subjected to various types of abnormal increased current flow. An abnormal increase in current flow up to six times the normal current flow is considered an overload current. Current flows of still higher magnitudes are considered short circuit currents. But for the inclusion of a fuse in a circuit, short circuit currents in the circuit may be limited very little in magnitude by the remaining circuit elements. Depending on the electrical circuit to be protected, separate electrical fuses have been provided in the past for protecting circuits against overload currents and short circuit currents. Further, in the case of overload currents, it has been found desirable to control the time delay, following the initiation of the overload current, after which the fuse interrupts the overload current flow. The limiting of such time delay may be important to protect the circuit elements, while lengthening the time delay may be desirable in circuits which are expected to experience temporary overload currents of limited duration. Such overload currents may be experienced in motor starting and upon first energizing a transformer. In electrical circuits which must be provided with protection with respect to both overload currents and short circuit currents, such protection has sometimes been provided in the past by separate fuses, one providing the protection against overload currents, and the other providing the protection against short circuit currents. Fuses have been constructed which provide both types of protection. However, the construction of some such fuses have been quite complex and therefore quite costly. Further, when such a dual purpose fuse is designed to meet particular overload and short circuit current interrupting specifications, particular components of the fuse would have to be changed to vary the overload or short circuit current interrupting characteristics.

SUMMARY OF THE INVENTION

The present invention provides an improved composite fuse which comprises in combination a time delay overload and a short circuit device connected electrically in a series circuit arrangement. The composite fuse has enhanced operating characteristics which are not provided by either of the constituent devices separately. In accordance with the present invention, an electrical heating means is connected in series with and located in immediate proximity to an overload time delay fuse device. In the presence of an overload current, the heating means provides increased heat transfer to the overload fuse device, so as to provide quicker interruption by the overload device in a desired current range. A short circuit fuse device connected in series with the time delay overload device provides the desired interruption of short circuit currents. Further, by containing the time delay overload device and the short circuit device in an insulating housing containing electrically insulating fill material, a composite fuse construction is provided which will reliably operate at a voltage higher than that for which either of the component fuse devices are rated.

By way of example, a time delay fuse may be particularly designed to conduct 200% of its rated current for 12 seconds before opening to interrupt current flow in the circuit which it protects. However, the same time delay fuse would conduct 500% of rated current for only 1/10 of a second before opening to interrupt the protected circuit. In a typical time lag fuse application, it is desirable for the fuse to conduct 500% of rated current for 10 seconds. If it is desirable to provide a time lag fuse, rated at 10 amperes, which will conduct 500% of rated current or 50 amperes for 10 seconds, it has been found that a time delay fuse rated at 25 amperes will provide the desired interruption of 500% of rated current, i.e. 50 amperes, after 10 seconds delay. However, the 25 ampere time delay fuse would not open for a 135% or 13.5 ampere overload current. In order to provide the desired current interruption at 135% of rated current, an electrical heating means is connected in series with the time delay fuse rated at 25 amperes. The electrical heating means is located in immediate proximity to the time delay fuse. The electrical heating means is designed to transfer sufficient heat to the time delay fuse to cause it to open as desired for 135% overload currents, i.e. 13.5 amperes. However, the heat transfer path between the electrical heating means and the fuse is such that with overload currents above 500%, and with short circuit currents, the heat transfer from the electrical heater to the time delay fuse is sufficiently delayed, that it does not have a significant effect on the time delay before fuse operation interrupts the circuit.

Commercially available time delay fuses having current ratings in the desired range for use in time lag fuses in accordance with this invention typically have voltage ratings below 250 volts, some as low as 32 volts, for larger current ratings. However, the desired voltage rating of the composite time lag fuse of this invention is typically over 250 volts, and may even be as high as 600 volts. By connecting the time delay fuse and electrical heating means in series with a short circuit fuse device in an end to end or overlapping relationship, all within an elongated insulating housing filled with an electrically insulating arc suppressing medium, it is possible to provide a time lag fuse having the desired higher voltage rating, such as 250–500 volts, while using a time delay fuse having a much lower voltage rating, such as 32 to 250 volts.

By constructing the composite time lag fuse utilizing both a readily available overcurrent time delay fuse and a readily available short circuit fuse, it is possible to provide the desired overload and short circuit fusing characteristics in a device requiring a lesser number of specially made components and at a lesser cost that would be experienced, were the readily available overload time delay and short circuit devices not utilized.

It is therefore an object of the present invention to provide an improved composite time lag fuse which provides desired overload time delay and short circuit interruption characteristics, which is assembled from separate overload time delay and short circuit devices.

A further object of the invention is to provide a composite fuse device utilizing separate overload time delay and short circuit devices which has enhanced time lag operation characteristics.

A still further object of the invention is to provide a composite time lag fuse comprising separate overload time delay and short circuit elements which is capable of operating at voltages greater than those of either of the separate component devices.

Other objects, features, and advantages of the present invention will become apparent by making reference to the accompanying drawings and description.

DETAILED DESCRIPTION OF THE PREFERRED EMBODIMENT

Figure 1:
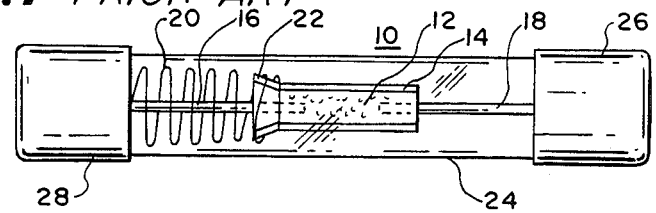
FIG. 1 PRIOR ART
FIG. 1 is a side view of a prior art time delay fuse which is utilized in the composite fuse construction of the present invention.

Throughout the FIGURES of the drawings, similar components of the various embodiments are identified by the same reference numerals.

Referring to the drawing, and initially to FIG. 1, there is illustrated a slow blow or time delay type fuse generally designated by the reference numeral 10. Fuses of this type are commercially available from the assignee of the present application, being sold under the model type designators "MDL" and "MSL". The operating element of the fuse 10 includes a body 12 of fusing alloy, which is contained within a supporting member 14, which may be formed of brass or copper. A pair of conductive elements 16 and 18 are embedded in a spaced apart relationship in the body 12 of fusing alloy. A tension spring 20 surrounding the conductor 16, engages at its right end enlarged portion 22 of the supporting member 14. The fuse components just described are placed in a glass tube 24 with the conductor 18 being electrically and physically connected to a conductive end cap 26 on the right end of the glass tube 24. The conductor 16 is electrically and mechanically connected to conductive end cap 28 on the left end of the glass tube. An electrical circuit is thus formed between end caps 26 and 28 by the conductors 16 and 18, and the body 12 of fusing alloy. The left end of tension spring 20 is secured in the region of end cap 28, such that a force is provided on supporting member 14, urging it to the left. When an overload current flows through the conductors 16 and 18, and body 12 of fusing alloy for a sufficient time to raise the body of fusing alloy 12 to its melting temperature, the fusing alloy will lose its grip on the conductors 16 and 18, permitting the spring 20 to pull the supporting member 14 to the left. As a result of the displacement of supporting member 14, the fusing alloy bridge between the inner ends of conductor's 16 and 18 will be removed, thereby opening the electrical circuit between end caps 26 and 28.

It has been found desirable to provide a time lag fuse which will open at a predetermined low overload current, i.e. for instance 135% to 200%, in a shorter period of time than the fuse 10 of FIG. 1 is designed to open. This desire is met, in accordance with the present invention, by providing the fuse 10 of FIG. 2 with a pair of heating coils 30 and 32. An insulated wire 34 comprising a center conductor 35 and an insulating cover 37 is wound around the glass tube 24 just to the left of the end cap 26, so as to encircle the conductor 18. One end of conductor 35 is soldered or welded at 36 to end cap 26. Similarly, at the left end of FIG. 2, an insulated wire 38 comprising a center conductor 40 and an insulating cover 42 is wound around the glass tube 24, so as to encircle the conductor 16. The conductor 40 is attached to the end cap 28 by soldering or welding at 44. Two heating coils 30 and 32 are provided, rather than just one longer one, so as to maintain the necessary spacing of conductive elements to prevent undesirable voltage breakdowns between conductive elements of the fuse assembly.

Figure 2:
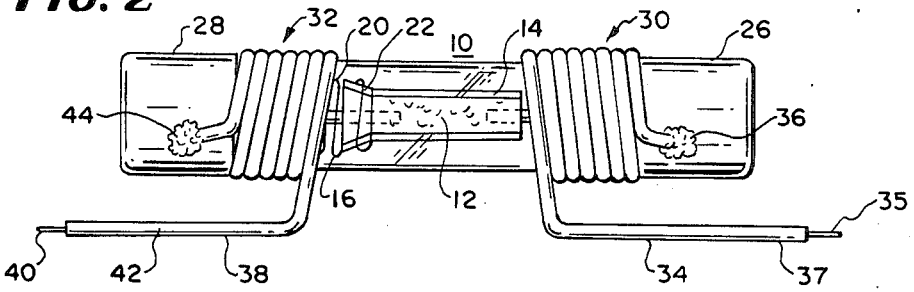
FIG. 2 is a side view of the prior art time delay fuse shown in FIG. 1, provided with heating coils in accordance with the present invention.
Figure 3:
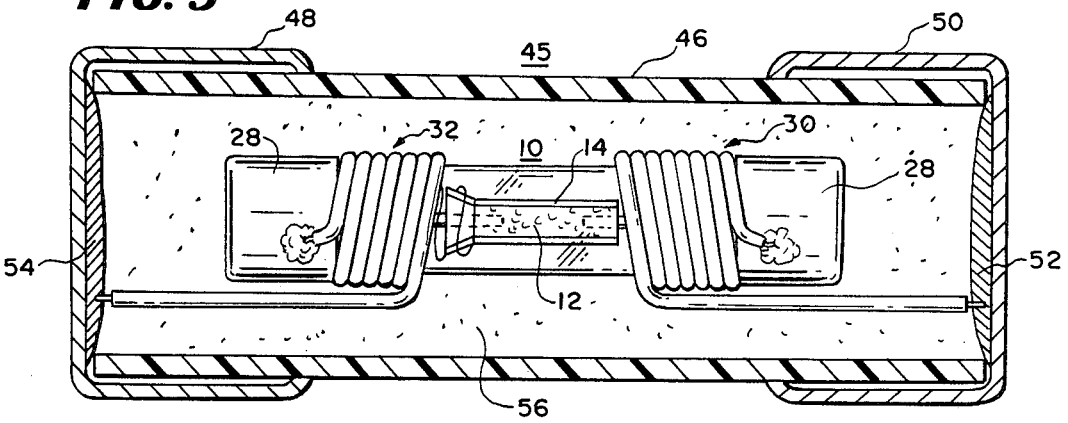
FIG. 3 is a partial cross sectional view showing the composite fuse of the present invention incorporating the subassembly of FIG. 2.

The subassembly, shown in FIG. 2, is assembled into a time lag fuse 45, constructed in accordance with this invention, as shown in FIG. 3. An insulating housing 46 of sufficient internal volume to enclose the subassembly of FIG. 2 is provided with conductive end caps 48 and 50. The subassembly of FIG. 2 is centered within the insulating housing 46, with conductor 35 being electrically and mechanically secured to end cap 50 by soldering or welding material 52. Similarly conductor 40 is electrically and mechanically connected to end cap 48 by soldering or welding material 54. That portion of the space within the insulating housing 46, which is not occupied by the subassembly shown in FIG. 2, is filled with an electrically non-conductive granular fill material 56, such as sand.

The time lag fuse assembly 45, shown in FIGURE 3, provides the desired time lag fuse performance characteristics which are not provided by the fuse 10 of FIG. 1. The conductors 35 and 40 are formed of resistance wire, chosen to generate, for transfer to the fuse 10, a predetermined amount of heat at a particular overload current so as to cause the fuse 10 to open faster than it would with the same overload current flow without the heating coils. A further enchancement of the operating characteristics of the composite time lag fuse 45, shown in FIG. 3, over the time delay fuse 10, shown in FIGURE 1, is provided by the housing 46 and the granular fil material 56. The provision of the housing 44 and the electrically insulating granular fill material 56 ensures proper operation of the device at higher voltages than would be permitted by the fuse 10 alone, as shown in FIG. 1.

As compared to the fuse 10 of FIG. 1, the composite time lag fuse construction of FIG. 3 will provide the desired time delayed opening of the circuit for overload currents in the approximate range of 135 to 600 percent of rated current. As overload currents continue to increase above 600 percent, the heating coils have a lesser and lesser effect in causing the fuse to open the circuit sooner, wherein the overload current flow through the body 12 of fusing alloy will cause it to melt prior to the heat transferred from the coils 30 and 32 being effective to heat the body 12 of fusing alloy. However, the composite time lag fuse 45, shown in FIG. 3, is not provided with enhanced short circuit current interruption capabilities.

Figure 4:
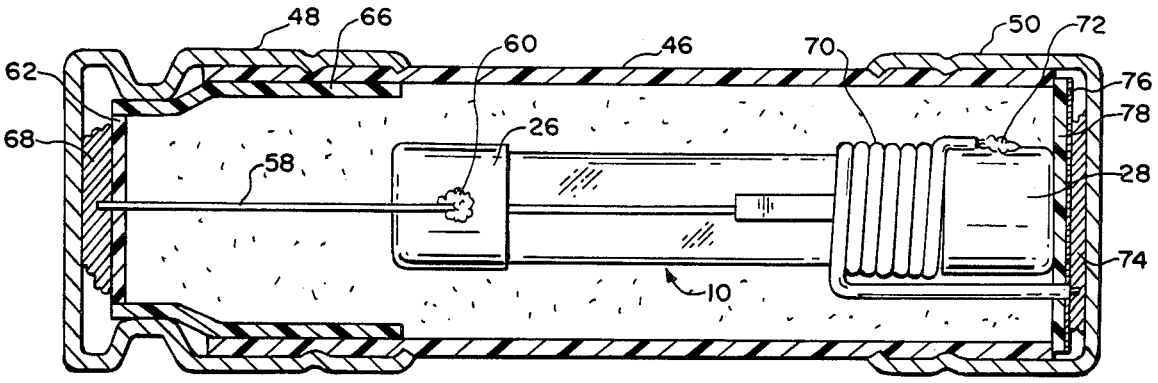
FIG. 4 is a sectional side view of a second embodiment of the present invention.

Referring to FIG. 4, a preferred embodiment of the present invention is shown. A time delay fuse 10 of the type shown in FIG. 1, is again used as the overload current trigger element. A bare wire 58 is soldered or welded to the end cap 28, as shown at 60, and extends to the left through an insulating member 62. The insulating member 62 together with a formed cylindrical insulating member 66 closes the left end of the insulating housing 46. End cap 48 is electrically end mechanically connected to the left end of conductor or wire 58 by solder or weld material 68. At the right end of the assembly, an insulated resistance heating wire 70 is wound around the glass tube 24 to overlay the conductive element 16, which is shown on the left in FIG. 1. One end of the conductor of insulated resistance heating wire 70 is soldered or welded to the end cap 28 and 72. The other end extends to the right to be connected electrically and mechanically by solder or weld material 74 to both the end cap 50, and to a metal layer 76 formed on the right side of an insulating washer 78. The embodiment of the invention, shown in FIG. 4, offers not only the advantages of the embodiment of the invention shown in FIG. 3, but also improved short circuit current interruption capabilities. The material and cross-sectional area of bare wire 58 is selected to provide the desired short circuit current interrupting capabilities. With the provision of only one resistance heating wire 70, rather than two, it is possible to obtain different, yet equally desirable heat transfer characteristics so as to provide current interruption for a predetermined percentage overload current with a preselected time delay. As compared to using the trigger element or time delay fuse 10 alone, higher voltage operation is possible due to the use of the short circuit wire 58 and the longer housing. The voltage rating of the composite time lag fuse of FIG. 4 is determined by the electrical characteristics of trigger element 10, the short circuit wire 58, and by the length of the insulating housing 46.

Figure 5:
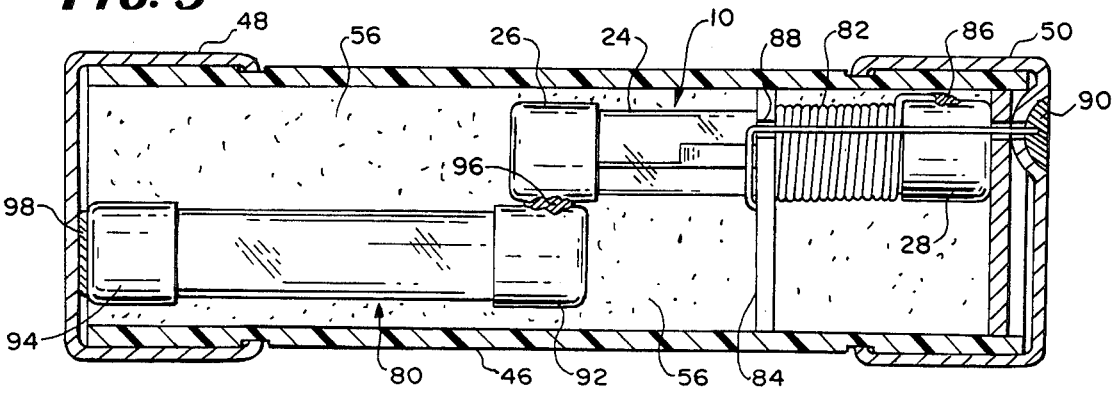
FIG. 5 is a sectional side view of a third embodiment of the present invention.

Another preferred embodiment of this invention is shown in FIG. 5. In addition to a time delay fuse 10, similar to that shown in FIG. 4, a short circuit fuse 80 having desired short circuit current interrupting characteristics is utilized. In the preferred embodiment shown in FIG. 5, a finer resistance heating wire 82 is utilized, so as to provide more heat at lower overload currents. An insulating support member 84 is provided with a notch which engages the insulating tube 24, and is positioned to confine the heating wire 82 in the desired position on insulating tube 24. One end of the resistance heating wire 82 is connected to the right end cap 28 by solder or a weld, as shown at 86. The other end of the resistance heating wire 82 extends to the right, through an aperture 88 in support member 84 to be soldered or welded, as shown at 90, to the composite fuse end cap 50. Short circuit fuse 80 is provided with a right end cap 92 and left end cap 94. The right end cap 92 is electrically and mechanically connected to the left end cap 26 by soldering or welding at 96. As is the case in previously discussed embodiments, the left end cap 94 is electrically and mechanically connected to the left end cap 48 of the composite fuse by solder or welding material 98. The composite fuse shown in FIG. 5, not only provides the enhanced overload current interrupting capabilities of the embodiment shown in FIG. 4, but further provides the enhanced short circuit current interrupting capability contributed by the fuse 80. The short circuit current interrupting capabilities of the fuse 80 are enhanced, in terms of voltage capabilities, by enveloping the fuse 80 in the granular electrically insulating fill material 56. The granular fill material 56 enveloping the fuse 80 permits it to be dependably operated at higher voltages than it would if used in air.

Figure 6:
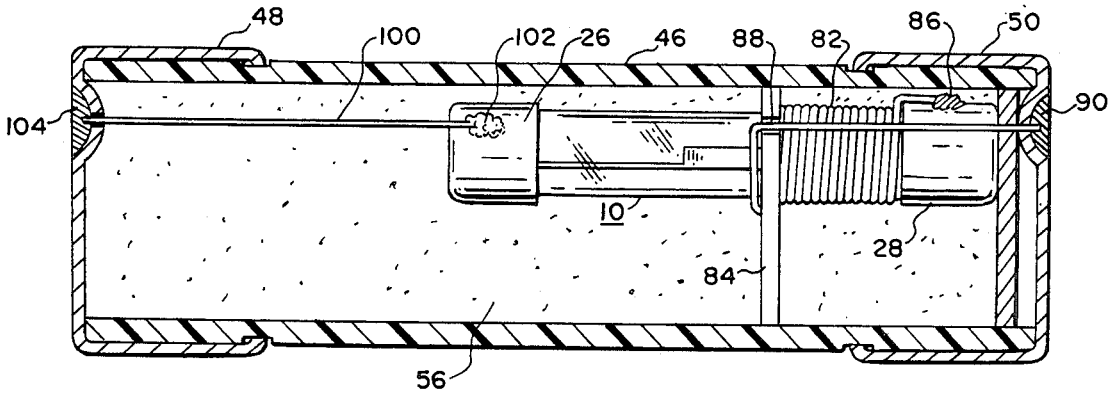
FIG. 6 is a sectional side view of a fourth embodiment of the present invention.

The preferred embodiment shown in FIG. 6 is similar to that shown in FIG. 5, except that the short circuit current interrupting element is shown as a wire 100, which is soldered or welded to end cap 26 at 102 and to the end cap 48 at 104. Again, the embodiment shown in FIG. 6 provides alll the enhanced characteristics with respect to time delay for overload currents in the range of 135 to 600%, of the device shown in FIG. 5, but further provides the enhanced short circuit characteristics attributable to the use of the short circuit wire 100, as set forth for the embodiment shown in FIG. 4.

Figure 7:
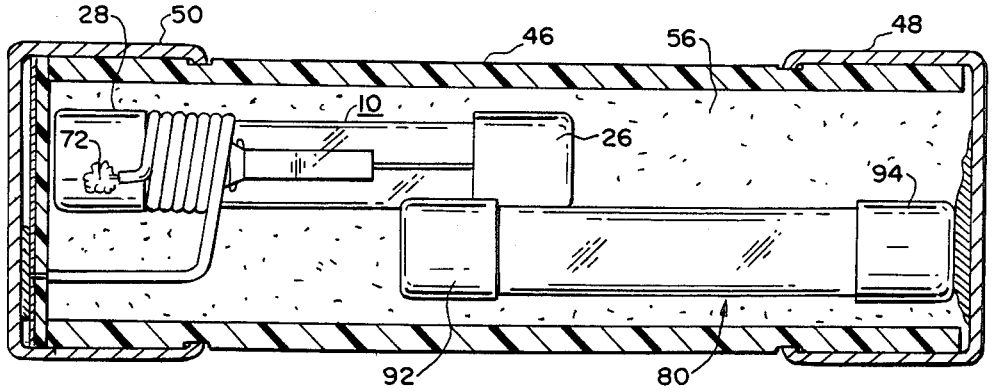
FIG. 7 is a sectional side view of a fifth embodiment of the present invention.
Figure 8:
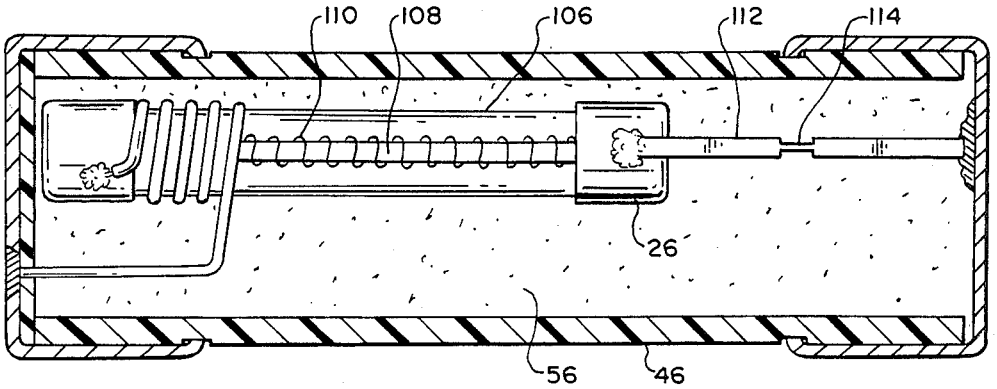
FIG. 8 is a sectional side view of a sixth embodiment of the present invention.

The embodiment shown in FIG. 7 combines features of the embodiments shown in FIGS. 4 and 5. As compared to FIG. 4, this embodiment provides the enhanced characteristics with respect to interrupting short circuit currents which are attributable to the short circuit fuse 80.

Wherein this invention contemplates a composite fuse construction combining the desired overload current interruptive characteristics of one fuse and the short circuit current interruptive characteristics of another fuse, both enclosed in a housing which provides an enhanced voltage rating, still other embodiments of the invention are contemplated. Referring to FIG. 8, the use of still another type of time delay fuse 106 is illustrated. The time delay fuse 106 is described in U.S. Pat. No. 4,517,544—Spaunhorst, assigned to the assignee of the subject application. The time delay fuse 106 includes an electrically insulative cylindrical core 108 around which is wrapped a uninsulated fusible wire 110. The short circuit fuse 112 is shown as a fusible ribbon having an area of reduce cross section 114.

Figure 9:
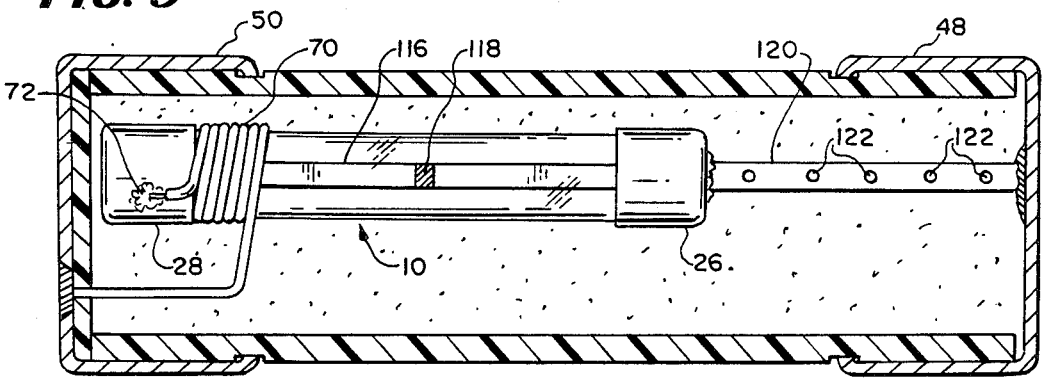
FIG. 9 is a sectional side view of a seventh embodiment of the present invention.

In the embodiment of this invention shown in FIG. 9, the time delay fuse 10 is shown to include a fusbile ribbon 116, having a portion loaded with a conductive material 118, which upon heating forms a amalgam with the ribbon 116, to provide opening at the desired temperature. The short circuit fusible member 120 is shown to be a fusible ribbon having a plurality of portions of reduced cross section formed by providing holes 122 in the ribbon.

Figure 10:
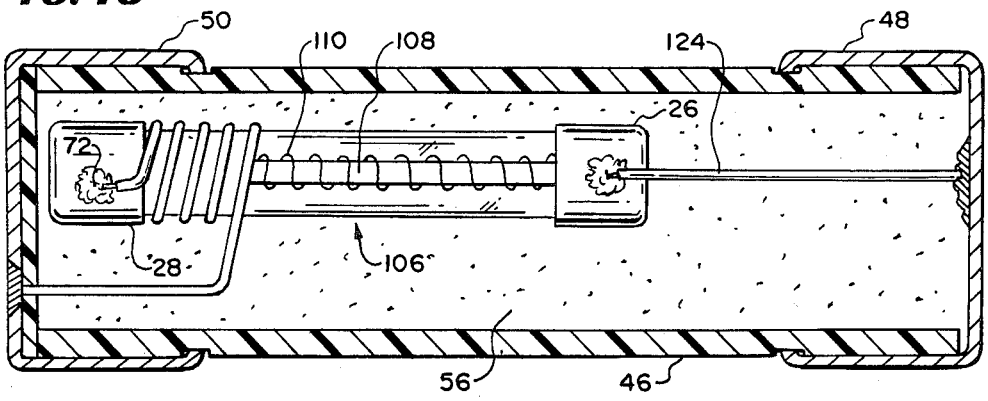
FIG. 10 is a sectional side view of a eighth embodiment of the present invention.

Finally, the embodiment of the invention shown in FIG. 10 is similar to that shown in FIG. 8, except that a fusible cylindrical wire 124 is provided in place of the fusible ribbon 116. Further, in embodiments shown in both FIGS. 8 and 10, the resistance wire heating coil is formed of uninsulated wire, with the turns formed in a spaced apart relationship upon the glass housing of the time delay fuse.

The embodiments of the present invention described herein present the preferred embodiments of the invention. However, it is to be understood that changes and modifications thereto are within the intent and spirit of the present invention.

I claim:

1. A time lag fuse comprising, a time delay fuse;

at least one electrical resistance heating means connected in a series circuit with said time delay fuse, and located in intimate heat transfer relationship with said time delay fuse;

a short circuit fuse connected in series in said series circuit, said short circuit fuse being enclosed in a first elongated insulating housing having first and second ends, first and second electrically conductive end caps secured to and closing said first and second ends respectively of said first insulating housing, and said first and second electrically conductive end caps being connected in said series circuit;

a second elongated hollow insulating housing having first and second ends, enclosing said time delay fuse, said electrical resistance heating means and said short circuit fuse; and third and fourth electrically conductive end caps secured to and closing said first and second ends respectively of said second insulating housing, said series circuit being connected between said third and fourth end caps, said end caps being connected in series with a circuit to be protected, such that overload current flow in said at least one electrical resistance heating means will result in the generation and transfer of heat from said at least one electrical resistance heating means to said time delay fuse, to cause said time delay fuse to interrupt, after a predetermined time delay, an overload current flow in the circuit to be interrupted, which overload current is of a lesser magnitude than would otherwise be interrupted by said time delay fuse.

2. The time lag fuse of claim 1, wherein one of said first or second end caps is electrically and mechanically connected to one of said third or fourth end caps.

3. A time lag fuse comprising, a time delay fuse, said time delay fuse being enclosed in a first elongated insulating housing having first and second ends, with first and second electrically conductive end caps secured to and closing said first and second ends respectively of said first insulating housing;

at least one electrical resistance heating means connected in a series circuit with said time delay fuse, and located in intimate heat transfer relationship with said first insulating housing;

a second elongated hollow insulating housing having first and second ends, enclosing said time delay fuse and said electrical resistance heating means; and third and fourth electrically conductive end caps secured to and closing said first and second ends respectively of said second insulating housing, said series circuit being connected between said third and fourth end caps, said end caps being connected in series with a circuit to be protected, such that overload current flow in said at least one electrical resistance heating means will result in the generation and transfer of heat from said at least one electrical resistance heating means to said time delay fuse, to cause said time delay fuse to interrupt, after a predetermined time delay, an overload current flow in the circuit to be interrupted, which overload current is of a lesser magnitude than would otherwise be interrupted by said time delay fuse.

4. The time lag fuse of claim 3, wherein said at least one electrical resistance heating means includes a coil of wire surrounding a portion of said second insulating housing adjacent said third electrically conductive end cap, one end of said coil of wire being electrically and mechanically connected to said third electrically conductive end cap, and the other end of said coil of wire being electrically and mechanically connected to said first end cap, a short circuit fuse having first and second terminals connected in series in said series circuit and enclosed in said elongated hollow insulating housing, said first terminal of said short circuit fuse being connected to said fourth electrically conductive end cap, and said second terminal of said short circuit fuse being connected to said second end cap.

5. The time lag fuse of claim 3, wherein said at least one electrical resistance heating means includes two separate coils of wire, a first one of said coils surrounds a portion of said second elongated insulating housing adjacent said third end cap, and a second one of said coils surrounds a portion of said second elongated insulating housing adjacent said fourth end cap, such that said first and second coils are spaced apart from each other.

6. The time lag fuse of claim 3, wherein said at least one electrical resistance heating means includes a coil of wire surrounding a portion of said second elongated insulating housing.

7. The time lag fuse of claim 6, wherein said coil of wire is formed of spaced apart turns of bare wire.

8. The time lag fuse of claim 6, wherein an insulating support member is provided to engage said second elongated insulating housing and support it within said first elongated insulating housing, said insulating support member confining said coil of wire to surround a predetermined portion of said second elongated insulating housing.

9. The time lag fuse of claim 3, wherein a short circuit fuse is enclosed in a third elongated insulating housing having first and second ends, with fifth and sixth electrically conductive end caps secured to and closing said first and second ends respectively of said third insulating housing.

10. The time lag fuse of claim 9, wherein one of said third and fourth end caps is electrically and mechanically connected to one of said fifth and sixth end caps.

* * * * *